US005905226A

United States Patent [19]

Baginski

[11] Patent Number: 5,905,226

[45] Date of Patent: May 18, 1999

[54] RADIO FREQUENCY AND ELECTROSTATIC DISCHARGE INSENSITIVE ELECTRO-EXPLOSIVE DEVICES HAVING NON-LINEAR RESISTANCES

[75] Inventor: Thomas A. Baginski, Auburn, Ala.

[73] Assignee: Auburn University, Auburn, Ala.

[21] Appl. No.: 08/970,127

[22] Filed: Nov. 13, 1997

Related U.S. Application Data

[62] Division of application No. 08/518,169, Aug. 24, 1995.

[51] Int. Cl.[6] ..... F42B 3/18

[52] U.S. Cl. ..... 102/202.2; 102/202.7; 102/202.9

[58] Field of Search ..... 102/202.1, 202.2, 102/202.3, 202.4, 202.5, 202.7, 202.9, 202.11

[56] References Cited

U.S. PATENT DOCUMENTS

| | | | |
|---|---|---|---|
| 2,821,139 | 1/1958 | Apstein et al. | 102/70.2 |
| 3,211,096 | 10/1965 | Forney et al. | 102/28 |
| 3,420,174 | 1/1969 | Potter | 102/28 |
| 3,572,247 | 3/1971 | Warshall | 102/28 |
| 3,640,224 | 2/1972 | Petrick et al. | 102/28 |
| 3,669,022 | 6/1972 | Dahn et al. | 102/28 EB |
| 3,682,096 | 8/1972 | Ludke et al. | 102/28 R |
| 3,735,705 | 5/1973 | Hudson, Jr. et al. | 102/28 R |
| 3,753,403 | 8/1973 | Menichelli | 102/28 R |
| 3,831,523 | 8/1974 | Thomas et al. | 102/28 R |
| 3,882,324 | 5/1975 | Smolker et al. | 307/202 A |
| 3,974,424 | 8/1976 | Lee | 317/80 |
| 4,061,088 | 12/1977 | Ueda | 102/28 R |
| 4,271,453 | 6/1981 | Yajima et al. | 371/248 |
| 4,304,184 | 12/1981 | Jones | 102/202.13 |
| 4,378,738 | 4/1983 | Proctor et al. | 102/202.7 |
| 4,422,381 | 12/1983 | Barrett | 102/202.2 |
| 4,428,292 | 1/1984 | Riggs | 102/202.7 |
| 4,484,523 | 11/1984 | Smith et al. | 102/202.5 |
| 4,517,895 | 5/1985 | Rucker | 102/202.2 |

(List continued on next page.)

FOREIGN PATENT DOCUMENTS

| | | |
|---|---|---|
| 581316 | 8/1959 | Canada . |
| 0567959A2 | 11/1993 | European Pat. Off. . |
| 3502526 | 8/1985 | Germany . |
| 3918408A1 | 12/1990 | Germany . |

OTHER PUBLICATIONS

The Semiconductor Junction Igniter: A Novel RF and ESD Insensitive Electro–Explosive Device (pp. 412–418, Mar. 1993 IEEE Transactions on Industry Applications vol. 29, No. 2.

*Primary Examiner*—Harold J. Tudor
*Attorney, Agent, or Firm*—Womble Carlyle Sandridge & Rice

[57] ABSTRACT

An electro-explosive device has two serpentine resistors fabricated on a thermally conductive substrate with the resistors being interconnected by a central bridge element. The resistance of the bridge element is much lower than that of the serpentine resistors and the serpentine resistors have a much larger surface area to volume ratio. A layer of zirconium is placed on the bridge element and explodes into a plasma along with the bridge element in order to ignite a pyrotechnic compound. The resistance of the bridge element increases with temperature whereby the bridge element receives more of the energy from the applied signal as the temperature increases. The EED is insensitive to coupled RF energy and to an electrostatic discharge since most of the energy from these stray signals is directed to the serpentine resistors and not to the bridge element. In another embodiment, two of the resistors are metal-oxide phase variable resistances and a third resistor is formed from a bowtie-shaped layer of zirconium. The resistances through the metal-oxide phase layers decrease with signal intensity whereby the zirconium can receive most of the energy from a high intensity firing signal. A shunting element, which may be placed across an EED, has a bowtie-shaped conductive layer formed on a substrate. The conductive layer explodes in a plasma above a certain signal intensity. The shunting element may comprise another type of device, such as a diode, capacitor, etc.

7 Claims, 4 Drawing Sheets

U.S. PATENT DOCUMENTS

| | | | |
|---|---|---|---|
| 4,586,435 | 5/1986 | Bock | 102/202.5 |
| 4,592,280 | 6/1986 | Shores | 102/202.2 |
| 4,690,056 | 9/1987 | Brede et al. | 102/202.2 |
| 4,708,060 | 11/1987 | Bickes, Jr. et al. | 102/202.7 |
| 4,729,315 | 3/1988 | Proffit et al. | 102/202.9 |
| 4,779,532 | 10/1988 | Riley et al. | 102/202.2 |
| 4,819,560 | 4/1989 | Patz et al. | 102/202.5 |
| 4,840,122 | 6/1989 | Nerheim | 102/202.5 |
| 4,862,803 | 9/1989 | Nerheim et al. | 102/202.5 |
| 4,893,563 | 1/1990 | Baginski | 102/202.2 |
| 4,944,224 | 7/1990 | Fiedler et al. | 102/202.2 |
| 4,967,665 | 11/1990 | Baginski | 102/202.2 |
| 4,976,200 | 12/1990 | Benson et al. | 102/202.7 |
| 5,085,146 | 2/1992 | Baginski | 102/202.5 |
| 5,088,413 | 2/1992 | Huber et al. | 102/202.5 |
| 5,099,762 | 3/1992 | Drapala | 102/202.1 |
| 5,179,248 | 1/1993 | Hartman et al. | 102/202.4 |
| 5,309,841 | 5/1994 | Hartman et al. | 102/202.4 |
| 5,448,114 | 9/1995 | Kondoh et al. | 257/778 |
| 5,454,320 | 10/1995 | Hilden et al. | 102/202.7 |
| 5,544,585 | 8/1996 | Duguet | 102/202.5 |

RADIO FREQUENCY AND ELECTROSTATIC DISCHARGE INSENSITIVE ELECTRO-EXPLOSIVE DEVICES HAVING NON-LINEAR RESISTANCES

"This is a divisional of copending application(s) Ser. No. 08/518,169 filed on Aug. 24, 1995."

FIELD OF INVENTION

This invention generally relates to an electro-explosive device and, more particularly, to a radio frequency and electrostatic discharge insensitive electro-explosive device having non-linear resistances.

BACKGROUND OF THE INVENTION

In general, an electro-explosive device (EED) receives electrical energy and initiates a mechanical shock wave and/or an exothermic reaction, such as combustion, deflagration, or detonation. The EED has been used in both commercial and government applications for a variety of purposes, such as to initiate airbags in automobiles or to activate an energy source in an ordnance system.

With reference to FIG. 1, a typical EED 10 comprises a thin resistive wire or bridgewire 12 suspended between two posts 14, only one of which is shown. The bridgewire 12 is surrounded by a flammable compound 18, commonly referred to as a pyrotechnic mix. To initiate combustion of the pyrotechnic mix 18, a DC or very low frequency current is supplied through lead wires 16 and posts 14 and then through the bridgewire 12. The current passing through the bridgewire 12 results in ohmic heating of the bridgewire 12 and, when the bridgewire 12 reaches the ignition temperature of the pyrotechnic mix 18, the pyrotechnic mix 18 initiates. The pyrotechnic mix 18 is a primary charge which ignites a secondary charge 20, which in turn ignites a main charge 22. The EED 10 further comprises various protective elements, such as a sleeve 23, a plug 24, and a case 26.

Although the EED 10 is a well known device, the electromagnetic environment in which EED's operate has changed dramatically over the past four decades. One change that has occurred in the operating environment for the EED's is that the EED's are being subjected to higher levels of electromagnetic interference (EMI). The necessary operation of high power radar and communication equipment in the proximity of EED's, such as in an aircraft carrier flight deck, has resulted in a typical operating environment that includes high intensity electromagnetic fields. The EED which initiates an airbag in an automobile may be subjected to severe EMI during the normal life-span of the automobile. Thus, EED's are being subjected to high levels of EMI in both military and non-military environments.

The high intensity radio-frequency (RF) fields which present a serious EMI problem can couple electromagnetic energy either through a direct or indirect path to an EED and cause accidental firing. Electromagnetic energy may be coupled directly to the EED when RF radiation is incident on the EED's chassis whereby the EED acts as the load of a receiving antenna. The electromagnetic energy may alternatively be coupled indirectly to the EED when RF induced arcing occurs in the vicinity of the EED and is coupled to the EED, such as through its leads. An RF induced discharge can occur whenever a charge accumulated across an air gap is sufficient to ionize the gas and sustain an ionized channel.

The EED's which are located in the vicinity of intense RF fields, such as naval surface ships, may receive signal components due to rectification of RF radiation. The RF radiation can be rectified, for instance, due to simple metal contact diode action, which is generally caused by corrosion of contacts or incorrectly connected fasteners. The rectified signal may have components that are at much lower frequencies than the source RF radiation and may also contain a DC component, any of which may couple to the EED and cause accidental ignition. The RF radiation may be rectified in many environments in which an EED may be found, including an automotive environment where large currents or voltages are switched very quickly thereby producing high levels of noise.

Another manner in which an EED may be accidentally discharged is by the coupling of an electrostatic discharge (ESD) to the EED. An ESD is characterized as a signal which is of a high voltage and fairly low energy. While the energy of the ESD is usually insufficient to cause any significant ohmic heating of the EED, the high voltage can create a sufficiently large electric field between the input pins of the EED to ignite the pyrotechnic mix.

One approach to protect an EED from EMI is to install one or more passive filters. Several standard types of passive filters exist which can be utilized to attenuate stray RF signals. These filters can usually be classified as either L, Pi, or T types, or as combinations of the three types. The L, Pi, and T type passive filters, which are respectively illustrated in FIGS. 2(A), (B), and (C), have traditionally been used as a first measure of eliminating EMI problems.

Conventional passive filters being used with EED's, however, have several disadvantages. A conventional filter consists of a combination of inductors, capacitors and/or other lossy elements, such as resistive ferrites. In general, the performance of the filter is directly proportional to the number and size of the elements used in its construction. Thus, a filter can be designed to attenuate a signal to a larger extent if the size of the inductors, capacitors and ferrite sleeves are all increased. Also, a filter having a greater number of stages will generally have an improved performance. The size of the filter, however, is often limited by the amount of available space. As a result, it may not be possible to add a filter to an EED or the filter which can fit within the available space may be ineffective in protecting the EED from EMI.

The filters are usually constructed from standard passive components assembled on a printed circuit board or hard-wired within a metal chassis. A typical example of an RF filter 30 is shown in FIG. 3(A). The RF filter 30 comprises, inter alia, a ceramic capacitor 32 and a wound torroidal inductor 34. As shown in FIG. 3(B), the ceramic capacitor 32 has a plurality of electrode layers 38 separated by a ceramic dielectric material 36. As should be apparent from FIG. 3(A), the size of the capacitor 32 and inductor 34 render the filter 30 too large for many applications, such as with weapon systems where space is especially limited. Therefore, a need exists for a small sized EED which is adequately protected from EMI.

In addition to the constraint of available space, the cost of the EED and filter can also limit the size of the filter. The cost of each filter is directly related to the number of capacitors, inductors, and other elements forming the filter. Even though some filters may have only a few components, the cost per unit price in assembling the filter may be relatively high in comparison to the cost of an EED. Thus, with a large scale production of EED's and their associated filters, the overall increase in cost can become quite substantial.

A further disadvantage to passive filters is that they are unable to filter out many low frequency signals which can cause accidental firing of the EED. Because the signal for firing an EED is a DC signal, the conventional filters are designed to freely transmit DC and other low frequency signals. These filters, therefore, are unable to attenuate the low frequency signals due to rectification of RF signals as well as other low frequency or DC signals.

Even with a filter that can effectively filter many types of EMI, the EED is not completely safe from accidental firing. In a conventional filter system, the filter and EED are essentially two separate components. With reference to FIG. 4, a non-propagating magnetic field B may induce an emf via closed loop induction. The emf is proportional to $\omega AB$, where $B=\mu_o H$, A is the cross-sectional area, and $\omega$ is the frequency of the magnetic field B.

The EED can be further protected from EMI by shielding. The shielding of an EED, however, is effective only if construction of a barrier and operational procedures can guarantee the integrity of the shielding structure. When a large number of EED's are manufactured, it becomes likely that some of the EED's will have defective shielding structure. Thus, shielding of the EED is not the best approach in protecting the EED.

Another device designed to protect an EED from accidental firing is a spark gap arrester. The spark gap arrester is used to reduce the chance that an electrostatic discharge (ESD) will produce an accidental firing and is essentially comprised of two conductive electrodes separated a precise distance, thereby defining an air gap. When the strength of an electric field developed across the conductors exceeds the dielectric strength of the air, a breakdown occurs and excess electric charge is free to flow across the air gap from one conductor to the other conductor. The conductor which receives the excess charge is typically connected to ground so that the charge is directed away from any sensitive elements in the EED.

A spark gap arrester relies upon precise spacing of electrodes to assure that a static discharge is shunted to the ground. The mechanics of constructing the precise air gaps can involve expensive manufacturing techniques. As a result, a spark gap arrester can significantly increase the cost of an EED.

The spark gap arrester may also be destroyed during installation and handling of the EED. A typical spark gap arrester is a discharge disc or sheet having a central opening through which lead wires can extend. A thin electrically conductive layer is in contact with the casing of the EED but is out of contact with the lead wires by the precise air gap. If the lead wires are bent, such as during assembly, the effectiveness of the spark gap may be severely hampered.

In order to reduce the sensitivity of an EED to stray signals, the total energy of the firing signal which is necessary to ignite the EED may be increased. As a result, low level stray signals can be conducted through the bridgewire without causing any ignition and only the higher level firing signal would have sufficient energy to ignite the EED.

A higher magnitude firing signal, however, is not always desirable. An EED typically has an initiation system which supplies the EED with the firing signal. The initiation system typically has a capacitor which stores the charge necessary for generating the firing signal. If the energy of the firing signal is increased and voltage remains constant, the size of the capacitor must also increase. Because of the larger capacitor, the cost of the initiation system substantially increases. Thus, by decreasing the magnitude of the firing signal, the cost of the EED and initiation system can be reduced.

It is also desirable to have a lower firing signal when the amount of available power or energy is limited. For instance, many automobiles are presently being manufactured with dual air bags, each of which requires a separate EED. Future designs of automobiles may have five or more airbags and may additionally employ EED's to actuate seat belts in the event of a collision. With the larger number of EED's that will likely be in an automobile, the magnitude of the firing signal should be as small as possible.

In the automobile environment, an airbag must be activated as quickly as possible in the event of a collision in order to maximize the amount of protection provided to the occupant of the vehicle. The EED which activates the airbag must therefore be able to ignite quickly, yet cannot be accidentally ignited with stray RF or with an ESD. Further, as described above, the EED should additionally be activated with a low energy firing signal. It has been difficult in the industry to produce an EED which can be activated quickly, which is insensitive to RF and to an ESD and is inexpensive to manufacture, and which is ignited with a low energy firing signal.

The use of an EED in an automotive environment presents other difficulties as well. For instance, the EED commonly used today to activate automotive airbags typically uses lead-azide as a primary charge. Lead-azide is an extremely explosive material and produces a fast travelling shock wave when ignited. Due to the highly explosive nature of lead-azide and the magnitude of the shock wave produced upon explosion, a steel mesh must necessarily be placed around the EED to prevent the shock output of the EED from rupturing the airbag. The high strength steel mesh, however, complicates the manufacturing process and adds further cost to the EED structure. A need therefore exists for a lower cost EED which does not require the use of a primary explosive.

The sensitivity of an EED also may be lowered with the use of a ferrite bead. When a hollowed ferrite bead is placed over a wire, the ferrite bead will pass the DC firing signal but will present an impedance that increases with frequency. Thus, with EMI, the ferrite bead will present an impedance to these signals which will thereby convert the electromagnetic energy from the signals into heat.

The effectiveness of a ferrite bead is rather limited. As the intensity of the stray signal increases, the temperature of the ferrite bead rises and, at a certain temperature, the ferrite bead loses its magnetic characteristics. Once the ferrite bead becomes too hot, the EMI is no longer converted by the ferrite bead into heat but is instead coupled to the EED, possibly igniting the EED. Thus, at higher signal levels, the ferrite bead is unable to divert the EMI away from the EED.

SUMMARY OF THE INVENTION

It is a general object of the invention to overcome the above-mentioned disadvantages of the prior art.

It is an object of the present invention to provide an electro-explosive device which is insensitive to electromagnetic interference.

It is another object of the present invention to provide an electro-explosive device which is insensitive to electrostatic discharge.

It is a further object of the present invention to provide an electro-explosive device which is insensitive to stray RF fields.

It is yet another object of the present invention to provide a small-sized electro-explosive device.

It is yet a further object of the present invention to provide a relatively low cost electro-explosive device.

It is a still further object of the present invention to provide an electro-explosive device which can be ignited with a low energy signal.

Additional objects, advantages and novel features of the invention are set forth in the description which follows, and will become readily apparent to those skilled in the art.

To achieve the foregoing and other objects, in accordance with the present invention, in a preferred embodiment thereof, an electro-explosive device (EED) is fabricated on a substrate and comprises first and second elements fabricated on the substrate both of which have a first resistance. A third element interconnects the two elements, has a second resistance which is much less than the first resistance, and is for evaporating in a plasma to ignite a pyrotechnic compound. The series connection of the three elements presents an overall resistance which has nonlinear characteristics. At low signal intensities, the third element receives significantly less energy from an applied signal than the other two elements. At higher signal intensities, however, the resistance of the third element is much more than the other two elements whereby the third element receives most of the energy from the applied signal.

In one embodiment, the first, second, and third elements are comprised of a layer of aluminum with the first and second elements being formed in a serpentine-shape and having a surface area to volume ratio which is much higher than that for the third element. As a result, a stray RF signal as well as an ESD have most of their energy converted into heat by the serpentine elements and only a small amount dissipated by the third element. The substrate is preferably thermally conductive so that any heat generated by the first or third element is directed away from the first or third element. To aid and improve the ignition process, a layer of zirconium is deposited onto the third element and heats up along with the third element. The zirconium layer explodes in a plasma along with the third element and both of these materials condense on the pyrotechnic compound, which comprises a mixture of zirconium and potassium perchlorate. An EED according to the invention can operate quicker and more efficiently since the vaporized zirconium can react directly with the potassium perchlorate in the pyrotechnic compound.

In another embodiment, the third element is formed from a bowtie-shaped layer of zirconium and the first two elements comprise metal-oxide resistances formed between an oxide phase formed on the zirconium layer and a metal in an overlying electrical contact. The electrical contacts are formed on either end of the zirconium layer and have a large surface area. The metal-oxide resistances are much larger than that of the zirconium layer but decrease with the intensity of the applied signal. Thus, with a higher intensity firing signal, the zirconium layer will receive more of the energy from the firing signal until the zirconium layer is converted to a plasma.

Another aspect of the invention relates to a shunting element for use with an electro-explosive device. The shunting element comprises a substrate and a conductive layer formed on the substrate. The conductive layer has a bowtie shape with a narrow central portion. First and second contacts are formed on either end of the bowtie-shaped conductive layer. The conductive layer presents a low impedance path between the first and second contacts. The central portion of the conductive layer acts as a fuse and evaporates in a plasma at a signal intensity above a certain threshold level. Preferably, the conductive layer comprises aluminum and the substrate is thermally conductive so that ohmic heat may be directed away from the aluminum layer.

BRIEF DESCRIPTION OF THE DRAWINGS

The accompanying drawings, which are incorporated in, and form a part of, the specification, illustrate preferred embodiments of the present invention and, together with the description, serve to illustrate and explain the principles of the invention. The drawings are not necessarily to scale, emphasis instead being placed on clearly illustrating the principles of the invention. In the drawings.

DETAILED DESCRIPTION

Figure 5A:
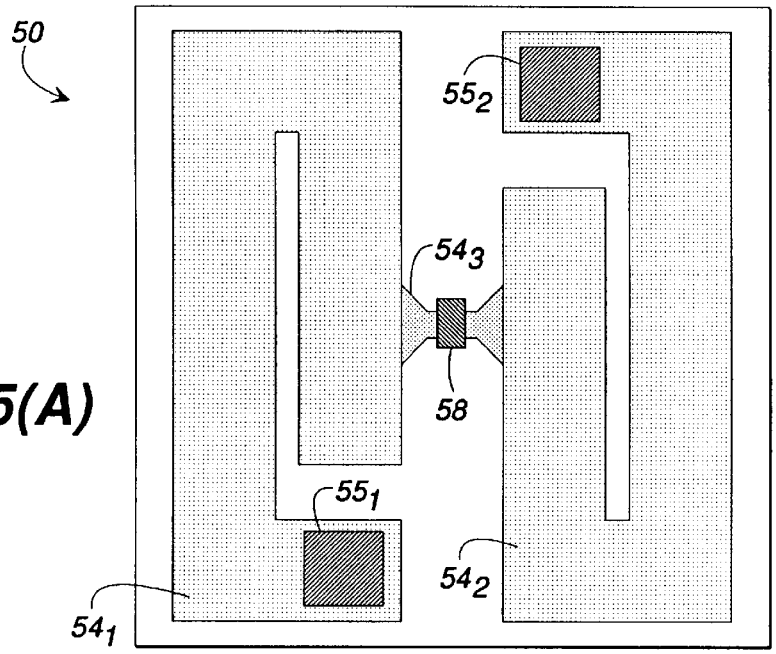
FIG. 5(A) is a top view of an electro-explosive device according to a first embodiment of the invention.

Reference will now be made in detail to the preferred embodiments of the invention, which are illustrated in the accompanying drawings. With reference to FIGS. 5(A) and (B), an electro-explosive device 50 according to a first embodiment of the invention comprises a silicon wafer or thermally conductive but electrically insulating substrate 52, such as alumina, with layers of silicon dioxide 53 on the front and back surfaces. The thin layers of silicon dioxide 53 provide electrical insulation from the substrate 52 while providing a low thermal resistance path from one side of the substrate 52 to the other. Preferably, the substrate 52 has a low nominal resistivity and has a width of about 250 mils and the layers 53 of silicon dioxide are about 500 nanometers in thickness.

A thin layer 54 of aluminum is deposited on top of the silicon dioxide layer 53 and is selectively etched away to produce a serpentine pattern. The layer 54 of aluminum forms a first path $\mathbf{54}_1$, a second path $\mathbf{54}_2$, and a bowtie area $\mathbf{54}_3$, with the bowtie area $\mathbf{54}_3$ interconnecting the first and second paths $\mathbf{54}_1$ and $\mathbf{54}_2$. The first and second paths $\mathbf{54}_1$ and $\mathbf{54}_2$ preferably have a width of about 50 mils and the bowtie area $\mathbf{54}_3$ preferably has dimensions of about 5 mils by 10 mils at the thinnest portion of the area $\mathbf{54}_3$.

A layer 58 of zirconium is selectively deposited over the bowtie region $\mathbf{54}_3$. The layer 58 of zirconium is not limited to the shape shown but may cover a greater or lesser area of the bowtie area $\mathbf{54}_3$. For instance, the layer 58 of zirconium may extend across almost the entire length of the bowtie area $\mathbf{54}_3$ from the first path $\mathbf{54}_1$ to the second path $\mathbf{54}_2$. The zirconium layer 58 is preferably about 1 $\mu$m in thickness.

Layers $55_1$ and $55_2$ of titanium/nickel/gold (Ti/Ni/Au) are selectively deposited over the ends of the aluminum paths $54_1$ and $54_2$, respectively. The titanium in the layers 55 provides adhesion to the aluminum layer 54, the nickel provides a solderable contact, and the gold protects the nickel surface from oxidation. Contact to the Ti/Ni/Au layers $55_1$ and $55_2$ on the aluminum paths $54_1$ and $54_2$ may be accomplished in any suitable manner, such as wire bonding, solder reflow, or conductive epoxy. The Ti/Ni/Au layers 55 are preferably about 0.6 $\mu$m in thickness.

Figure 1:
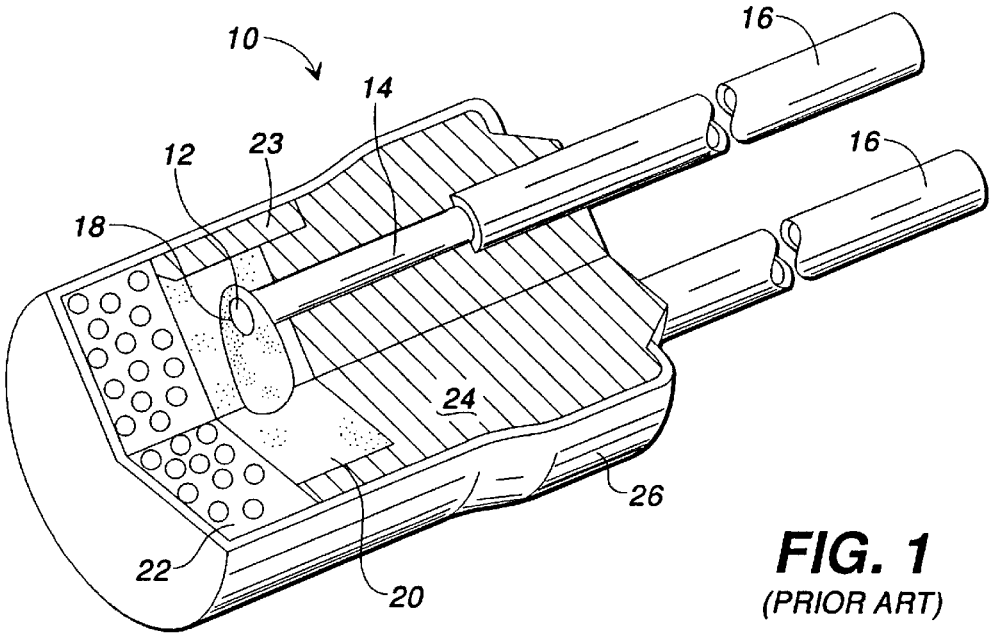
FIG. 1 (PRIOR ART)
FIG. 1 is a sectional perspective view of a conventional electro-explosive device.
Figure 2A:
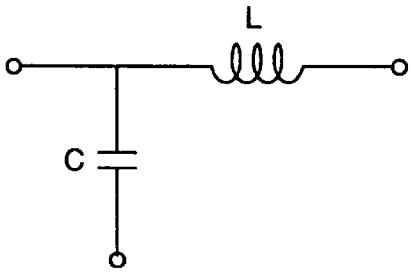
FIG. 2(A) (PRIOR ART)
FIGS. 2(A), (B), and (C) are equivalent circuit schematics for L, Pi, and T passive filters, respectively.
Figure 2B:
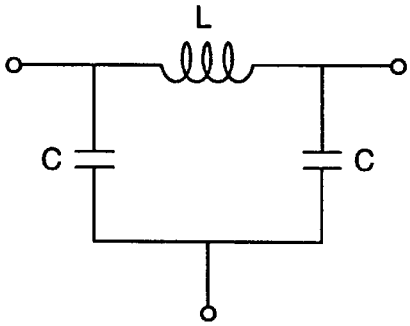
FIG. 2(B) (PRIOR ART)
Figure 2C:
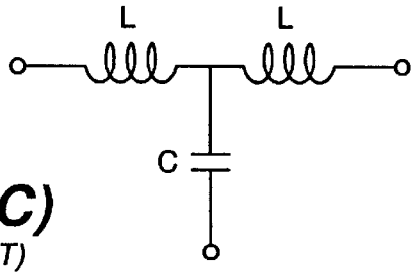
FIG. 2(C) (PRIOR ART)
Figure 3A:
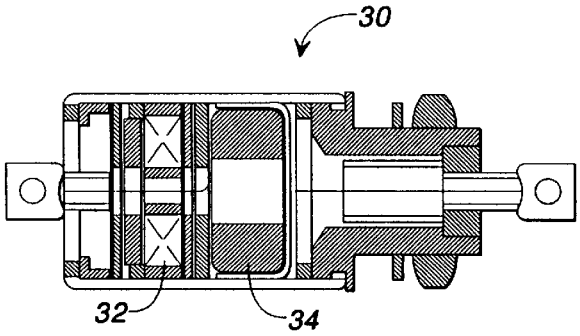
FIG. 3(A) (PRIOR ART)
FIG. 3(A) is a sectional side view of a conventional L-type passive filter.
Figure 3B:
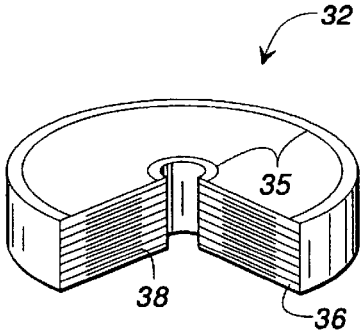
FIG. 3(B) (PRIOR ART)
FIG. 3(B) is a cut-away perspective view of a capacitor shown in the L-type passive filter of FIG. 3(A)
Figure 4:
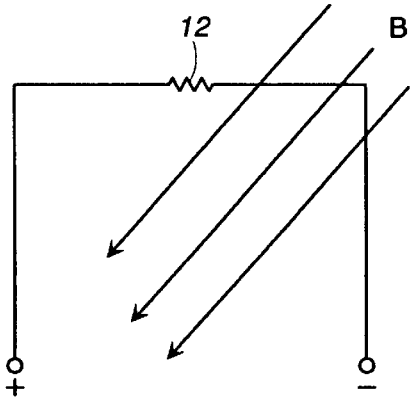
FIG. 4 (PRIOR ART)
FIG. 4 is a equivalent circuit of an EED showing magnetic field coupling.
Figure 6:
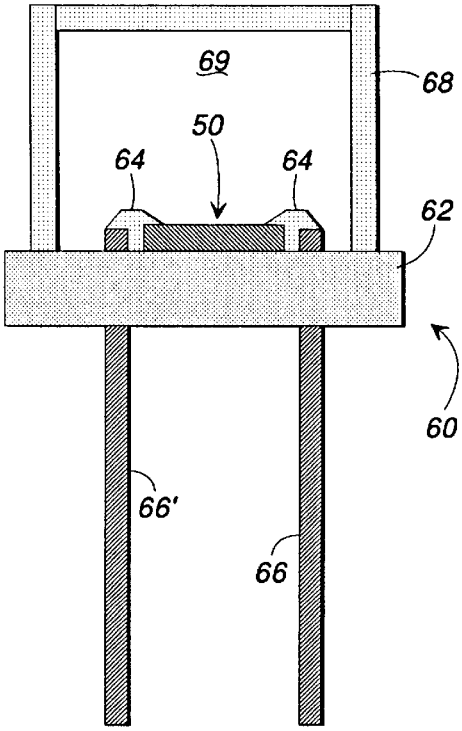
FIG. 6 is a side cross-sectional view of the electro-explosive device of FIG. 5(A) in an initiator.
Figure 5B:
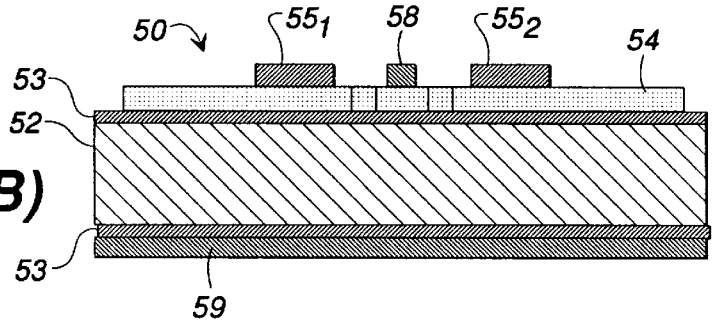
FIG. 5(B) is a side cross-sectional view of the electro-explosive device of FIG. 5(A)

With reference to FIGS. 5(B) and 6, an initiator 60 is formed by depositing a layer 59 of titanium/nickel/gold (Ti/Ni/Au) on the backside of the substrate 52 over the silicon dioxide layer 53 and then attaching the Ti/Ni/Au layer 59 to a header 62, which is preferably formed from a ceramic or metal alloy, such as Kovar™. The Ti/Ni/Au layer 59 is attached to the header 62 with a solder paste or conductive epoxy which is then heated to permit the solder to flow or the epoxy to cure. A conductive epoxy 64 is applied between pins 66 on the header 62 and the Ti/Ni/Au layers 55 and cap 68 is placed on the header 62 to form an enclosure filled with a gas generating mix or pyrotechnic mix 69.

In operation, a firing signal supplied to the initiator 60 is routed through the pins 66, through the conductive epoxy 64, and to the Ti/Ni/Au layers 55. The firing signal produces a current which travels along one of the two paths $54_1$ or $54_2$, through the bowtie area $54_3$ and then through the other of the two paths $54_1$ or $54_2$. The resistance of the aluminum layer 54 is essentially comprised of three resistors in series, with the paths $54_1$ and $54_2$ each having a resistance of $R_1$ and the bowtie area $54_3$ having a resistance of $R_b$.

In general, the resistance R of the aluminum layer 54 can be calculated from the following equation:

$$R = \rho\left(\frac{L}{hw}\right), \qquad \text{EQ. 1}$$

where ρ is the bulk resistivity of the material, L is the length of the metal trace, h is the height or thickness, and w is the width.

With the initiator 60, the electrical impedance presented to a signal applied to the pins 66 is purely resistive in nature and is approximately equal to the sum of $2R_1$ and $R_b$. The aluminum layer 54 defines a resistive divider network with the resistors $R_1$ and $R_b$ and the signal that is actually being applied to the bowtie area $54_b$ is attenuated by an amount equal to the ratio of $R_b/2R_1$. The attenuation A of the applied signal can be simplified as:

$$A = \frac{(L_b / w_b)}{(2L_p / w_p)}, \qquad \text{EQ. 2}$$

where $L_b$ and $W_b$ are the length and width of the bowtie area $54_3$ and $L_p$ and $w_p$ are the length and width of either path $54_1$ or $54_2$.

As is apparent from Equation 2, the attenuation A of a signal is a constant value at low levels of an input signal and is determined only by the relative length to width ratios of the resistors $R_1$ and $R_b$. The aluminum layer 54 is preferably designed to achieve an attenuation A of-about 1/20, which is about −26 dB. It will be apparent to those skilled in the art, however, that the amount of attenuation A is not limited to this exact value but that other values of attenuation A can be obtained by simply varying the geometries of the aluminum layer 54.

Due to the attenuation A obtained by the resistive network of resistors $R_1$ and resistor $R_b$, the majority of electrical power supplied to the initiator 60 is converted to heat by ohmically heating the two resistors $R_1$. The resistors $R_1$ possess a large surface to volume ratio so as to provide a large surface area for the conduction of heat from the resistors $R_1$, through the top layer of silicon dioxide 53, into the thermally conductive silicon substrate 52, and to the header 62. The initiator 60 may additionally have a heat sink to further dissipate heat away from the bowtie area $54_3$ and thus away from the zirconium layer 58.

The EED 50 is therefore insensitive to coupled RF power. Due to the resistive network defined by the resistors $R_1$ and $R_b$, the coupled RF power is attenuated whereby the bowtie $54_3$ receives only a fraction of the energy. Furthermore, because the heat from the resistors $R_1$ as well as the resistor $R_3$ is routed away from the bowtie area $54_3$, the bowtie area $54_3$ and the zirconium layer 58 remain relatively cool. Consequently, coupled RF power can be dissipated into heat without accidentally firing the EED 50.

The EED 50 is also insensitive to an electrostatic discharge (ESD) since the time period of the discharge is too short to heat the bowtie $54_3$ any appreciable amount. A pulsed signal from an ESD will have the vast majority of the energy coupled to the large resistors $R_1$ with the heat generated by the resistors $R_1$ being safely dissipated through the header 62.

In order to fire the EED 50, a current having a sufficiently long duration is passed through the resistors $R_1$ and $R_b$ to increase the temperatures of the resistor $R_b$. The resistors $R_1$ and $R_b$ have a positive temperature coefficient so that the resistances will increase with the temperature of the aluminum layer 54. Because the bowtie area $54_3$ is much smaller than the serpentine resistors $R_1$, the firing signal will cause the bowtie area $54_3$ to heat up much faster than the other areas $54_1$ and $54_2$. As the temperature of the bowtie area $54_3$ increases, the resistance of resistor $R_b$ will increase by upwards of two orders of magnitude and will eventually become larger than the resistors $R_1$, As a result, the bowtie area $54_3$ will receive most of the electrical power from the firing signal and will rapidly heat, and evaporate along with the zirconium layer 58 in a plasma.

The plasma condenses on a small area of nearby pyrotechnic compound 69 causing it to heat. Once a critical volume of the pyrotechnic material 69 reaches its ignition point, the entire pyrotechnic compound 69 ignites. The zirconium layer 58 assists in the ignition of the pyrotechnic compound 69 by increasing the mass of material in the bowtie area $54_3$ which will change from solid to plasma. With a larger mass, a greater amount of material is available to condense on the pyrotechnic powder 69 and a greater amount of thermal energy can be transferred.

As described above, when the temperature of the bowtie area $54_3$ increases, the resistance of resistor $R_b$ will increase. Once the bowtie area $54_3$ becomes molten, the resistance of resistor $R_b$, which has a geometry selected according to the resistance of an initiation system, matches the parasitic resistance of the initiation system supplying the firing signal. Thus, by matching the increased resistance of the aluminum layer 54 to the initiation system, the maximum amount of power can be transferred to the bowtie area $54_3$.

The pyrotechnic compound 69 is a combination of powdered zirconium and potassium perchlorate. With some previous EED's, a layer of conductive or semiconductor material is heated into a plasma state and the plasma condenses on the pyrotechnic compound in order to ignite the EED.

With the invention, on the other hand, the zirconium layer 58 is converted into the plasma state in conjunction with the bowtie area $54_3$. The vaporous zirconium aides in the ignition by directly reacting with the potassium perchlorate. The EED according to the invention is consequently a more efficient ignition mechanism since an element of the pyrotechnic mix 69 is vaporized with the metal. By using zirconium which burns upon ignition, an EED of the invention eliminates the need for a primary explosive, such as lead azide. As a result, the EED of the invention can be surrounded by a lower strength and lower cost steel mesh.

An EED according to the invention was subjected to a 12 MHz sinusoidal RF signal which coupled approximately 1.5 W of real power to the EED structure. The EED did not have any additional heat sink and no attempt was made to increase the airflow over the EED structure. After the EED was subjected to this signal for approximately 15 minutes, the heat was effectively dissipated from the EED structure whereby the EED structure could be easily held by hand. Also, a visual inspection of the serpentine resistor and bowtie did not reveal any damage. The EED structure was subjected to additional frequencies with similar results. The EED according to the invention is therefore insensitive to real RF power.

An EED according to the invention was also subjected to an ESD. The ESD consisted of current pulses of approximately 30 amps for a variety of time periods up to 1 $\mu$sec. A visual inspection of the EED structure after the ESD pulses did not reveal any damage. Due to the geometries of the serpentine resistors and bowtie, the ESD is primarily coupled to the serpentine resistors and away from the bowtie with most of the energy being dissipated by the serpentine resistors. The EED's were also repetitively pulsed with the result that no adverse effects had occurred.

To ensure that the EED's according to the invention would fire with a proper firing signal, EED's were connected to a 480 $\mu$F electrolytic capacitor which had been charged to 8 V. The capacitor was switched in series with the EED structure by a metal-oxide-semiconductor transistor (MOSFET). A variety of EED's were fired with this test setup after RF testing and after ESD testing to verify the functionality of the EED's. As expected, all of the EED's were ignited with a range of 1.0 $\mu$mJ to 3.0 $\mu$mJ total energy being absorbed from the electrolytic capacitor.

With the invention, only a small portion of the available 15 $\mu$mJ of energy is needed to fire the EED. An EED according to the invention can therefore be fired with low energies. The low energy firing capability of the invention is especially advantageous when an initiator firing circuit has a high parasitic resistance, such as in an automobile airbag system. The actuation of numerous EED's from a single low energy source is also much more feasible with a low firing energy device. Thus, a single low energy source may be able to activate the numerous airbags which will likely be installed in future designs of automobiles.

An EED according to the invention is a relatively simple integrated structure which can be produced with extremely small geometries. The EED provides a constant attenuation of stray RF and spurious signals across the entire frequency spectrum and can also safely and repetitively dissipate the energy of a typical ESD event in both pin-to-pin and pin-to-case modes.

The invention is not limited to the pyrotechnic compound of zirconium and potassium perchlorate but rather may employ other pyrotechnic compounds. For instance, the pyrotechnic compounds may comprise any suitable combination of a powdered metal with a suitable oxidizer, such as $TiH_{1.68}KClO_4$ or other mixtures such as boron and potassium nitrate $BKNO_3$. If potassium nitrate $BKNO_3$ were used as the pyrotechnic compound, a coating of boron could be applied over the bowtie area $54_3$ to enhance the ignition process. As will be apparent to those skilled in the art, by matching the hot vapor phase of the plasma to the pyrotechnic compound, a variety of materials can be used to coat the bowtie area $54_3$ to enhance the ignition process.

The material coating the bowtie area $54_3$ need not be in electrical contact with the bowtie area $54_3$ but may instead be electrically isolated from the bowtie area $54_3$. The material is primarily heated by conductive heat transfer from the bowtie area $54_3$ and is not caused by Joule heating, which occurs when a current flows through the material. Thus, one or more electrically insulating but thermally conductive materials can be placed between the bowtie area $54_3$ and the coating material.

The invention is also not limited to the serpentine resistors and/or the bowtie area being formed from aluminum but rather may be fabricated from a variety of different conductive materials such as printed conductive traces or conductive epoxy. Further, the dimensions of the serpentine resistors and bowtie area may be varied to obtain different magnitudes of attenuation. Also, an EED according to the invention may have a bowtie area without any type of coating material whereby only the bowtie area would evaporate in a plasma.

Figure 7A:
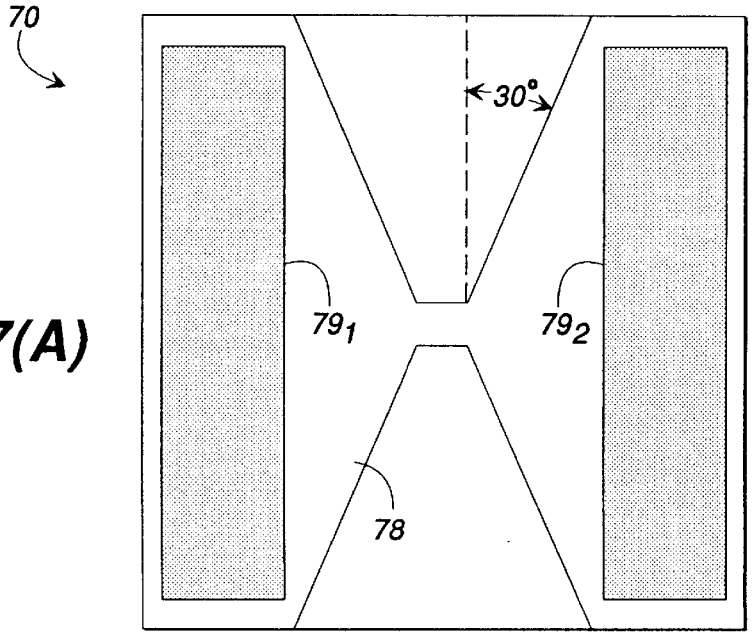
FIG. 7(A) is a top view of an electro-explosive device according to a second embodiment of the invention.
Figure 7B:
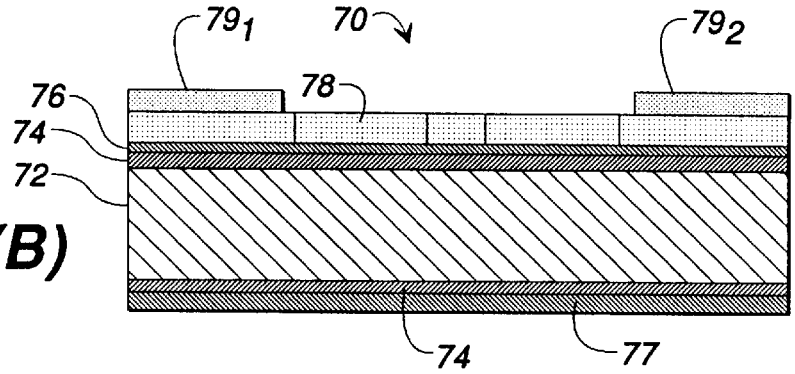
FIG. 7(B) is a side cross-sectional view of the electro-explosive device of FIG. 7(A).

In a second embodiment of the invention, as shown in FIGS. 7(A) and (B), an EED 70 comprises a silicon wafer or a thermally conductive but electrically insulating substrate 72, such as alumina, which has layers 74 of silicon dioxide grown on the front and back surfaces. The silicon dioxide layers 74 electrically insulate the substrate 72 while providing a low thermal path of resistance across the front and back surfaces of the substrate 72. Preferably, the substrate has a nominal low resistivity and is about 50 mils in width and length and the silicon dioxide layers 74 are approximately 500 nanometers in thickness.

A layer 76 of titanium is vapor deposited onto the front surface followed by a layer 78 of zirconium. The titanium layer 76 is preferably about 0.1 $\mu$m in thickness and the zirconium layer 78 is about 1 $\mu$m in thickness. The zirconium/titanium layer 78 is then selectively etched away to form a bowtie pattern having a central bridge portion with dimensions of about 1.5 mils by 1.5 mils.

A layer 77 of titanium/nickel/gold (Ti/Ni/Au) is deposited over the back layer 74 of silicon dioxide and Ti/Ni/Au layers $79_1$ and $79_2$ are also deposited over the ends of the bowtie shaped zirconium layer 78 to form contact pads. As with the embodiment of FIGS. 5(A) and (B), the EED 70 may be attached to the header 62 with a conductive epoxy connecting the header pins 66 to the Ti/Ni/Au contact pads $79_1$ and $79_2$, or with other interconnect schemes, including wirebonding, etc.

The resistance of the EED 70 is comprised of three resistors in series, with $R_{land}$ being the resistance through the Ti/Ni/Au layers 79 to either end of the bowtie-shaped zirconium layer 78 and $R_{bow}$ being the resistance of the bowtie-shaped zirconium layer 78. In the preferred embodiment, $R_{land}$ is approximately 10 to 20 ohms while $R_{bow}$ is only about 0.3 ohms. The resistance of the bowtie-shaped zirconium layer 78 is determined in accordance with Equation 1.

The electrical impedance presented to a signal applied across the Ti/Ni/Au contacts 79 is purely resistive in nature and is equal to the sum of $2R_{land}$ and $R_{bow}$. The signals reaching the zirconium layer 78 are attenuated by an amount A equal to $R_{bow}/2R_{land}$, which can be simplified as:

$$A = \frac{(L_{bow} / w_{bow})}{2R_{land}}, \quad \text{EQ. 3}$$

which is a constant value at low levels of input signal and is determined only by the length $L_{bow}$ and width $w_{bow}$ of the bowtie-shaped zirconium layer 78 and the resistances $R_{land}$. Although the attenuation A is preferably about 1/20, or −26 dB, any practical value of attenuation A may be achieved by simply varying the geometry of the zirconium layer 78.

With low levels of input signals, the resistances $R_{land}$, which are about 10 to 20 ohms, have a much larger surface to volume ratio than the resistance $R_{land}$. Thus, at these levels, the resistances $R_{land}$ receive most of the energy from the input signals and convert the energy into heat. The Ti/Ni/Au contacts 79 present a large surface area for the conduction of heat through the top silicon dioxide layer 74, through the thermally conductive substrate 72 and to the header 62. As a result, at low levels of input signal, the zirconium-shaped bowtie 78 dissipates only a fraction of the heat and remains relatively cool. Thus, the EED 70 can remain insensitive to any RF power or ESD which is coupled to the EED 70.

The EED 70 is ignited by supplying a firing signal which has a relatively high intensity. The resistances $R_{land}$ comprise metal-oxide variable resistances which are formed between the titanium layer in contacts 79 and an oxide-phase layer 78, formed on the zirconium layer 78. The metal-oxide variable resistances $R_{land}$ have a relatively high resistance at lower voltages, such as 25 ohms with an applied signal of 1 volt. With higher intensity signals, the metal-oxide resistances $R_{land}$ decrease substantially and become small in comparison to the resistance $R_{bow}$. As a result, with a high intensity firing signal, the resistance $R_{bow}$ will become the largest resistance and will accordingly receive most of the energy from the firing signal until the zirconium layer 78 evaporates in a plasma. The EED 70 may use the same types of pyrotechnic compound as that of EED 50.

The EED 70 may additionally comprise a shunting element connected in parallel between the Ti/Ni/Au contacts 79. The shunting element has a low impedance at RF frequencies and may comprise a ceramic capacitor, a diode arrangement, or a low impedance fuse. Further, the shunting element can be either a discrete component, a combination of discrete components, or integrated directly on the substrate 72.

An EED according to the second embodiment was found to have an RF impedance of about 12 ohms. A 0.1 μF ceramic capacitor was placed across the EED as the shunting element and the impedance was measured as 12∠0° ohms at 10 kHz and 0.3∠-65° ohms at 10 MHz. As expected, the impedance was primarily capacitive at higher frequencies. The inductance of the leads resonated at 4 MHz and appeared inductive at higher frequencies.

To conduct ESD testing, the EED of the second embodiment was subjected to current pulses of approximately 24 A for a variety of time periods up to a fraction of a microsecond. An inspection of the EED after the current pulses revealed that the EED was unaffected. The EED's were repetitively pulsed with no adverse consequences.

To ensure that the EED's of the second embodiment would fire after ESD and RF testing, the EED's were connected to a 40 μF electrolytic capacitor, which was charged to 22 volts, and was switched in series with the capacitor with a MOSFET transistor. A number of EED's were fired with this arrangement and absorbed from 1 mJ to 3 mJ of total energy. The peak currents measured in the EED were upwards of 16 amps for a duration of about 1 to 2 μs. The EED's 70 can therefore be ignited from only a small fraction of the 10 mJ of available energy. The EED's could also be ignited with a 480 μF capacitor charged to only 10 volts.

With the second embodiment of the invention, non-linear resistances $R_{land}$ are placed in series with the ignition element comprising the bowtie-shaped zirconium layer 78. The invention can therefore protect the ignition element from stray RF signals without the use of a large ferrite sleeve and capacitor. Also, the ignition element can be protected from an ESD without the use of other elements, such as diodes.

Figure 8A:
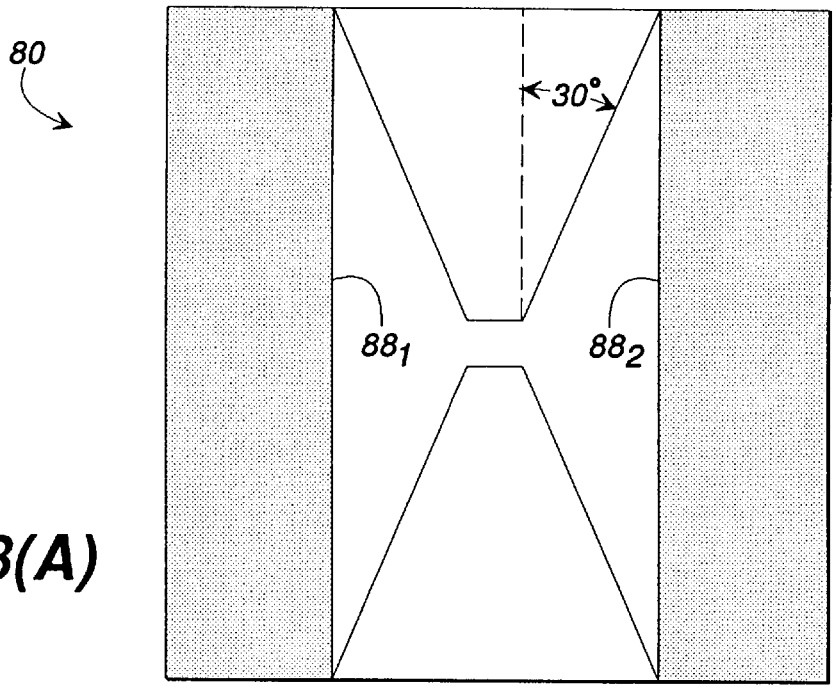
FIG. 8(A) is a top view of a shunting element according to a third embodiment of the invention.
Figure 8B:
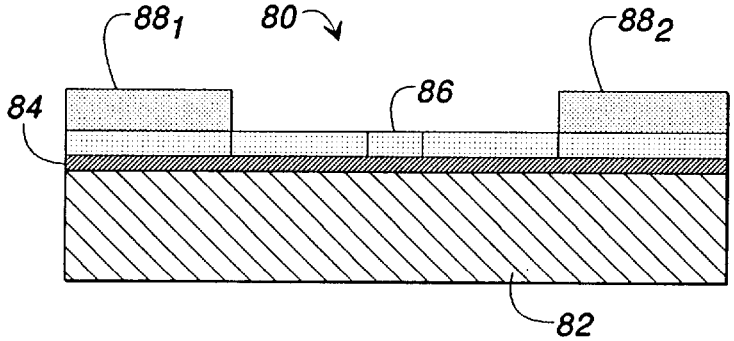
FIG. 8(B) is a side cross-sectional view of the shunting element of FIG. 8(A).

FIGS. 8(A) and (B) illustrate an example of a shunting element 80 which may be placed in parallel across an EED according to the invention, such as EED 50 or EED 70. In this example, the shunting element 80 comprises a low impedance fuse having a polished alumina or silicon substrate 82. A thin layer 84 of titanium is deposited onto the substrate 82 followed by a thicker layer 86 of aluminum which is selectively etched away to form a bowtie pattern. Preferably, the titanium layer 84 is about 0.1 μm in thickness and the aluminum layer is about 1.0 μm in thickness and has dimensions of about 1 mil by 1 mil at the bridge area of the bowtie pattern. Also, the substrate has a width of about 60 mils. Two layers of titanium/nickel/gold (Ti/Ni/Au) $\mathbf{88}_2$ and $\mathbf{88}_2$ are deposited onto either end of the bowtie-shaped aluminum layer 86 in order to form contacts for the shunting element 80.

The contacts $\mathbf{88}_1$ and $\mathbf{88}_2$ are connected in parallel to the contacts on the EED, such as contacts $\mathbf{55}_1$ and $\mathbf{55}_2$ or contacts $\mathbf{79}_1$ and $\mathbf{79}_2$. The resistance of the shunting element 80 is approximately 0.2 ohms and therefore provides low impedance resistive path for shunting the current away from the EED, thereby protecting the igniter. The shunting element 80 also preferably provides a low thermal impedance path from the aluminum layer 86 to the substrate 82 as well as to a heat sink which may be in thermal contact with the substrate 82.

With low levels of coupled RF energy and with an ESD, the energy is routed through the shunting element 80 due to its low impedance. When a firing signal is received, on the other hand, the firing signal has a duration and energy level which are sufficient to open-circuit the shunting element 80. Once the shunting element 80 has been removed from the circuit, the firing signal is coupled to the EED for igniting the EED. As will be apparent to those skilled in the art, the amount of energy needed to open-circuit the shunting element 80 can be adjusted by varying the geometry of the aluminum layer 86.

A shunting element according to the invention is not limited to the shunting element 80. For instance, a shunting element may be integrated on the same substrate as the EED or may be fabricated as a discrete component. Further, a diode may additionally or alternatively be used as the shunting element. A diode may be integrated directly onto the silicon substrate of the EED. For instance, a pn junction or a Schottky barrier both possess a high enough junction capacitance per unit area to effectively shunt stray RF signal. Furthermore, a shunting element according to the invention may be used in applications other than with an EED according to the invention, such as with other EED's or in entirely different types of circuits.

The foregoing description of the preferred embodiments of the invention has been presented for purposes of illustrating the features and principles thereof. It is not intended to be exhaustive or to limit the invention to the precise forms disclosed. Many modifications and variations are possible in light of the above teaching.

The embodiments were chosen and described in order to explain the principles of the invention and their practical application; various other possible embodiments with various modifications as are suited to the particular use are also contemplated and fall within the scope of the present invention.

I claim:

1. An electro-explosive device fabricated on a substrate, comprising:

a first layer formed from a metal, positioned on said substrate and shaped to have spaced ends and a narrow central portion joining between said ends of said layer;

an oxide-phase layer comprising a metal oxide formed over at least said ends of said first layer; and first and second electrical contacts comprising a metal and formed on the ends of said first layer over said oxide-phase layer to thereby form variable metal-oxide resistances between each of said contacts and said first layer, said metal-oxide resistances having a non-linear characteristic such that said metal-oxide resistances decrease with an increase in intensity of an applied signal;

wherein said variable metal-oxide resistances have a first resistance which is greater than a resistance of said narrow central portion when electromagnetic interference signals are present, and said variable metal oxide resistances have a second resistance that is less than said resistance of said narrow central portion when a higher intensity firing signal is applied, said firing signal for heating said first layer to cause said central portion to evaporate in a plasma and ignite a pyrotechnic compound positioned adjacent the electro-explosive device.

2. The electro-explosive device as set forth in claim 1, wherein said first layer comprises a component of said pyrotechnic compound.

3. The electro-explosive device as set forth in claim 2, wherein said component comprises zirconium and said pyrotechnic compound comprises a mixture of zirconium and potassium perchlorate.

4. The electro-explosive device as set forth in claim 1, wherein said contacts comprises titanium.

5. The electro-explosive device as set forth in claim 1, wherein stray RF signals applied to said device are converted into heat by said oxide-phase layer.

6. The electro-explosive device as set forth in claim 1, wherein an ESD applied to said device is converted into heat by said oxide-phase layer.

7. The electro-explosive device as set forth in claim 1, wherein said substrate comprises a thermally conductive material and said metal-oxide resistances have a surface area larger than said central portion of said first layer.

* * * * *